US006354879B1

(12) United States Patent
Plehaty

(10) Patent No.: US 6,354,879 B1
(45) Date of Patent: Mar. 12, 2002

(54) CONNECTOR FOR SHIELDED CONDUCTORS

(75) Inventor: Carl W. Plehaty, Erie, CO (US)

(73) Assignee: Ball Aerospace & Technologies Corp., Boulder, CO (US)

( * ) Notice: Subject to any disclaimer, the term of this patent is extended or adjusted under 35 U.S.C. 154(b) by 0 days.

(21) Appl. No.: 09/680,374

(22) Filed: Oct. 5, 2000

(51) Int. Cl.[7] ..... H01R 9/03
(52) U.S. Cl. ..... 439/610
(58) Field of Search ..... 439/610, 607, 439/608, 609, 101, 108, 465, 466, 467, 469, 472, 95, 497

(56) References Cited

U.S. PATENT DOCUMENTS

| | | | | | |
|---|---|---|---|---|---|
| 3,569,900 | A | | 3/1971 | Uberbacker | 339/14 |
| 3,864,011 | A | | 2/1975 | Huber | 339/103 M |
| 3,907,396 | A | | 9/1975 | Huber | 339/103 R |
| 4,367,005 | A | | 1/1983 | Douty et al. | 339/107 |
| 4,448,474 | A | | 5/1984 | Melnychenko | 339/103 M |
| 4,458,967 | A | | 7/1984 | King et al. | 339/14 R |
| 4,537,458 | A | | 8/1985 | Worth | 339/143 R |
| 4,577,920 | A | | 3/1986 | Coldren et al. | 339/143 R |
| 4,615,578 | A | | 10/1986 | Stadler et al. | 339/143 R |
| 4,627,673 | A | | 12/1986 | Barrus, Jr. | 339/14 R |
| 4,639,054 | A | | 1/1987 | Kersbergen | 339/14 R |
| 4,744,769 | A | * | 5/1988 | Grabbe et al. | 439/284 |
| 4,758,179 | A | | 7/1988 | Klein et al. | 439/497 |
| 4,781,615 | A | | 11/1988 | Davis et al. | 439/395 |
| 4,822,286 | A | | 4/1989 | Bianca | 439/610 |
| 4,827,228 | A | * | 5/1989 | Blakely | 333/167 |
| 4,921,441 | A | * | 5/1990 | Sauder | 439/460 |
| 4,975,068 | A | | 12/1990 | Squires | 439/67 |
| 4,992,060 | A | | 2/1991 | Meyer | 439/620 |
| 4,993,968 | A | * | 2/1991 | Guletsky et al. | 439/492 |
| 5,009,616 | A | | 4/1991 | Fogg et al. | 439/608 |
| 5,118,306 | A | * | 6/1992 | Bixler et al. | 439/405 |
| 5,123,859 | A | | 6/1992 | Davis et al. | 439/405 |
| 5,176,538 | A | * | 1/1993 | Hansell, III et al. | 439/607 |
| 5,195,909 | A | | 3/1993 | Huss, Jr. et al. | 439/465 |
| 5,259,792 | A | | 11/1993 | Beck et al. | 439/607 |
| 5,295,871 | A | * | 3/1994 | Lapraik et al. | 439/746 |
| 5,409,400 | A | * | 4/1995 | Davis | 439/610 |
| 5,474,473 | A | | 12/1995 | Perretta et al. | 439/610 |
| 5,788,528 | A | | 8/1998 | Orr, Jr. et al. | 439/358 |
| 5,848,914 | A | | 12/1998 | Lang et al. | 439/610 |
| 5,855,493 | A | | 1/1999 | Shelly | 439/465 |
| 6,203,376 | B1 | * | 3/2001 | Magajne et al. | 439/610 |

* cited by examiner

*Primary Examiner*—Gary Paumen
*Assistant Examiner*—Phuong Nguyen
(74) *Attorney, Agent, or Firm*—Sheridan Ross P.C.

(57) ABSTRACT

The present invention is directed to a connector for terminating a plurality of shielded conductors. The connector includes a conductive backshell housing, a connecting structure, one or more ground structures for grounding each of a plurality of conductive shields, and a strain relief structure. The ground structures are located inside the conductive backshell housing between the plurality of connecting elements and the passage in the housing for the cable. The connector is particularly useful in terminating a cable that includes a plurality of conductive shields surrounding one or more of the plurality of conductors.

23 Claims, 7 Drawing Sheets

CONNECTOR FOR SHIELDED CONDUCTORS

FIELD OF THE INVENTION

The present invention relates generally to electrical connectors and specifically to electrical connectors for terminating to conductors of a shielded cable.

BACKGROUND OF THE INVENTION

In many applications, particularly in military and aerospace applications, shielded cable, such as cable in accordance with the M27500 cable specification, is used. Typically, the shielded cable includes not one but a plurality of conductive shields surrounding one or more conductors in the cable. Typically, a single shield surrounds at least one and no more than ten conductors. In some cases, an outer conductive shield will surround the plurality of conductive shields and shielded conductors. The shields protect the signals transmitted along the conductors from electromagnetic interference (EMI) due to electromagnetic radiation in the ambient atmosphere. The shields must be grounded to protect the conductors from EMI. Typically, the connector includes a conductive backshell that grounds the shields when the connector is plugged into a receptacle.

The ground to the backshell can be effectuated by a number of approaches. In one approach, one or more shields are soldered to a conductor which is connected to the backshell. The shields can be daisy chained together by soldering to utilize the same ground conductor. The daisy-chained shields and conductor are typically located inside of the backshell to protect them from EMI. As will be appreciated, exposing the daisy chained shields to electromagnetic radiation in the external environment can seriously compromise or degrade the EMI resistance of the shields. The EMI resistance is further weakened by the build up of electrical resistance from shield to shield along the daisy chain. The use of soldering and daisy chaining is not only labor intensive but also produces "brown crud" contamination from the solder flux. The "brown crud" is solder flux that wicks up underneath the jacket along the shield braid. Brown crud contamination is a type of corrosion that is unacceptable in many applications.

In other approaches, the shields are engaged with a clamping ring or coil spring and the ring or spring compressed between a metal seat and a tightened metal nut. Although the grounded portion of the conductive shields are well protected by the outer wall of the seat and the nut from exposure to electromagnetic interference, the nut often requires the shield to be cut to the proper length and properly positioned to permit the nut to be engaged properly with threads located on the outer wall of the seat. Otherwise, the shields could engage the threads and interfere with nut tightening and/or generate loose pieces or fragments of the conductive shield(s). In many applications, the shield must be temporarily clamped or otherwise held in position before the nut is tightened to effectuate the ground. Even when the shields are cut to the proper length, rotation of the ring or spring in the seat during rotation of the nut can cause the grounded shields to rub or abraid or otherwise frictionally contact against the seat, which can cause small fragments of the shield to be broken off. Such small fragments can later be dislodged, such as during the launch of a space vehicle, causing electrical shorts and vehicle malfunctions. The ability to remove such debris is hindered by the inaccessibility of the grounded shields after the nut is tightened. The grounded shields are generally not visible after nut tightening, complicating inspection of the integrity of the ground connection. The ground structure in such connectors is radiused, which provides a high profile for the connector, thereby creating problems where space is at a premium.

SUMMARY OF THE INVENTION

These and other needs are addressed by one or more embodiments of the present invention. Generally, the present invention provides a connector that utilizes a ground structure located inside of the backshell to provide ease of shield grounding.

In one embodiment, a connector for terminating a plurality of shielded conductors is provided that includes:

(a) a conductive backshell housing including a passage for receiving a plurality of conductors, the passage being disposed at a distal end of the conductive backshell housing;

(b) a connecting structure including a plurality of connecting elements for connecting to the corresponding plurality of conductors wherein each of a plurality of conductive shields surrounds one or more of the plurality of conductors, the plurality of connecting elements being disposed at a proximal end of the conductive backshell housing;

(c) one or more ground structures for grounding each of the plurality of conductive shields, each of the one or more ground structures being located inside the conductive backshell housing between the plurality of connecting elements and the passage; and (d) a strain relief structure for restraining movement of the plurality of shielded conductors relative to the backshell housing.

The backshell housing can be composed of any conductive material and/or superconducting material and/or a composite of a conductive material and/or a superconducting material with a nonconducting material and/or a nonsuperconducting material. By way of example, the backshell housing can be composed of a plastic substrate with a metal coating. The backshell housing can be rectangular, circular, eliptical, or any other suitable cross-sectional shape and can be an integral or nonintegral (e.g., multipiece) assembly unit.

The connecting structure and connecting elements can be of any suitable configuration. Typically, the connecting structure has stacked rows of pin-type contacts.

The ground and strain relief structures can also be of any suitable configuration. For example, the structures can each include one or more movable clamping bars, jaws, or openings having smooth, serrated, ribbed, knurled, etc., configurations or edges that may be a part of or mounted on one or more parts of the backshell. In one configuration, the strain relief structure clamps the plurality of shielded conductors between a stationary bar (or a portion of the backshell) and a moveable bar and is located inside the backshell housing and near an opening of the passage. In one configuration, the ground structure clamps the conductive shield between a stationary bar (which is typically attached in some fashion to the backshell housing) and a surface of the conductive backshell housing (or another stationary bar).

In one configuration, the strain relief structure contacts an insulative cover enclosing the conductive shield and the plurality of shielded conductors. As will be appreciated, most shielded cables will have an insulated or dielectric (e.g., thermoplastic) cover. The cover is typically removed only as necessary to access the shields and the individual conductors, with the cover commonly being left in place where the cable contacts the strain relief structure.

The strain relief structure and ground structure can be located at any suitable location in the backshell. In one configuration, the strain relief structure is located between the ground structure and the distal end of the backshell housing. In another configuration, the ground structure is located between the ground structure and the distal end of the backshell housing.

The ground and strain relief structures can be formed by one or more integral or nonintegral components. In one configuration, the ground and/or strain relief structure includes a single unitary (or integral) bar for clamping or compressing a plurality of conductive shields or the cable, respectively. The bar (for either the ground and/or strain relief structure) may be moved or displaced by any suitable connector or connecting means such as one or more screws, a cam, a lever, a rivet, and a ratchet and locked or held in place by any suitable means such as one or more of a hook, a latch, a screw, a solder, a weld (e.g., a spot weld, an ultrasonic weld, etc.), a magnet, a rivet, an adhesive, and a lock washer. In another configuration, a plurality of ground structures is used, each of which includes a clamping bar, at least one end of which is secured to the conductive backshell housing, for electrically connecting at least a portion of the plurality of conductive shields with the conductive backshell housing. In the various configurations, rubbing, abrading, or other types of lateral movement of the shields is maintained at acceptable levels or substantially minimized.

The clamping bar in the ground and/or strain relief structures can be located in any suitable orientation relative to the backshell and/or another clamping bar. In one configuration, the clamping bar (of the ground and/or strain relief structures) is connected to the conductive backshell housing such that the bar moves in a direction that is at least substantially normal to at least a portion of a surface of the backshell housing to engage the plurality of shields but is at least substantially free of movement in a direction parallel to the surface. In one configuration, the bar moves in straight line motion relative to an adjacent surface of the backshell housing. In one configuration, the bar is at least substantially free of rotation (though the connectors connecting the bar to the backshell housing may rotate). In one configuration, the bar moves downwardly and upwardly relative to a ground surface of the backshell housing.

In another embodiment, a method for securing a plurality of shielded conductors to a connecting assembly is provided that includes the steps of:

(a) removing a portion of an insulating cover enclosing the plurality of conductors to provide access to a plurality of conductive shields enclosing the plurality of conductors;

(b) placing the plurality of conductively shielded conductors enclosed by the insulating cover into a strain relief structure in the connecting assembly;

(c) compressing the plurality of conductors in the strain relief structure to restrain movement of the plurality of conductors relative to a conductive backshell housing in the connecting assembly;

(d) engaging the accessible portions of the plurality of conductive shields with a ground structure in the connecting assembly, wherein at least a portion of the ground structure that contacts the plurality of conductive shields is at least substantially free of rotation in the engaging step (d); and (e) connecting the plurality of shielded conductors to a plurality of connecting elements in the connecting assembly.

As will be appreciated, the engaging and compressing steps generally occur at different times. Typically, the compressing step will precede the engaging step to permit the strain relief structure to stabilize movement of the cable during the grounding operation.

In yet another embodiment, a connector for terminating a plurality of shielded conductors, includes:

(a) a conductive backshell housing including a passage for receiving a plurality of conductors, the passage being disposed at a distal end of the conductive backshell housing;

(b) a connecting structure including a plurality of connecting elements for connecting to the corresponding plurality of conductors wherein each of a plurality of conductive shields surround one or more of the plurality of conductors, the plurality of connecting elements being disposed at a proximal end of the conductive backshell housing;

(c) a strain relief structure for restraining movement of the plurality of shielded conductors relative to the backshell housing; and (d) shield grounding means for clamping each of the plurality of conductive shields to a grounding surface of the conductive backshell housing. The shield grounding means is configured to maintain alignment with the grounding surface during engagement of the shield grounding means with the plurality of conductive shields. The shield grounding means can be any suitable clamping device, including without limitation one or more moveable or nonmoveable clamping bars or jaws, and/or a raised portion of the backshell housing that exerts a clamping force on the shields when the housing is assembled.

In one configuration, a grounding bar of the shield grounding means has freedom of movement in a direction at least substantially normal to the grounding surface of the backshell housing to engage the plurality of conductive shields and is at least substantially free of movement in a direction at least substantially parallel to the grounding surface.

In yet another embodiment, a method for grounding a plurality of shielded conductors is provided that includes the steps of:

(a) providing a plurality of conductive shields enclosing a plurality of conductors;

(b) passing the plurality of conductively shielded conductors through a passage in a backshell housing of a connecting assembly;

(c) engaging the plurality of conductively shielded conductors with a strain relief structure in the connecting assembly;

(d) after the passing step, engaging portions of the plurality of conductive shields with a ground structure in the connecting assembly; and (e) connecting the plurality of shielded conductors to a plurality of connecting elements in the connecting assembly.

The various steps can include one or more substeps. For example, the engaging step (c) can include the step of compressing the plurality of conductors in the strain relief structure to restrain movement of the plurality of conductors relative to a conductive backshell housing in the connecting assembly. In one configuration, the engaging step (d) occurs interiorly of the passage.

The various embodiments can have one or more advantages relative to conventional devices. The grounded conductive shields can be externally accessible via a removable plate in the backshell housing. This permits the integrity of the grounding to be checked by quality control personnel, periodically during operation, and/or during routine maintenance functions. The accessibility further permits fragments or shards of the conductive shields to be removed by suitable techniques such as with an inert gas. The location of the grounding structure within the backshell can significantly enhance the EMI protection or resistance afforded by the shields. The moveable clamping member or bar can provide ease of use or installation and therefore significant labor savings. The shield does not have to be trimmed to any particular length for the ground to be realized. The ability to use shields of varying lengths provides labor savings and reduces (relative to existing designs) the generation of fines or shards from cutting of the shields. The moveable clamping member or bar can be secured by solderless techniques, thereby eliminating "brown crud" and other types of solder-related contamination. The use of a clamping member or bar that has straight-line motion can prevent rubbing or abrading of the shields against the backshell or other clamping surface during clamping, thereby reducing, relative to conventional systems, the incidence of loose fragments or shards of conductive shield located in the backshell. This reduction further reduces, relative to conventional systems, malfunctions (e.g., electrical short circuits) attributable to such fragments, thereby increasing system reliability. The backshell can have a low profile (a height that is typically no more than about 0.060 inches greater than the maximum face height of the connector), which permits more connectors to be located or stacked in a given space. This small size can be especially important in applications where space is at a premium. The strain relief and ground structures can be located at discrete or spaced apart locations. The use of the same structure to perform both functions is poor practice and can lead to a loss of system integrity.

The foregoing summary is intended to be neither exhaustive nor complete. As will be appreciated by one of ordinary skill in the art, the above-noted features may be used alone or in combination to form other embodiments of the invention. Such other embodiments are considered to be a part of the invention(s) set forth and/or claimed herein.

DETAILED DESCRIPTION

Figure 3:
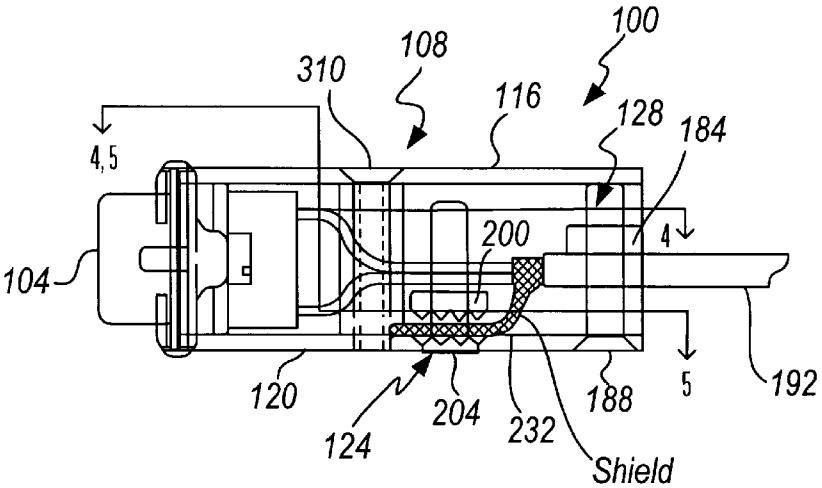
FIG. 3 is a side cross-sectional view of the backshell assembly of FIG. 1 along line 3—3 of FIG. 1.
Figure 1:
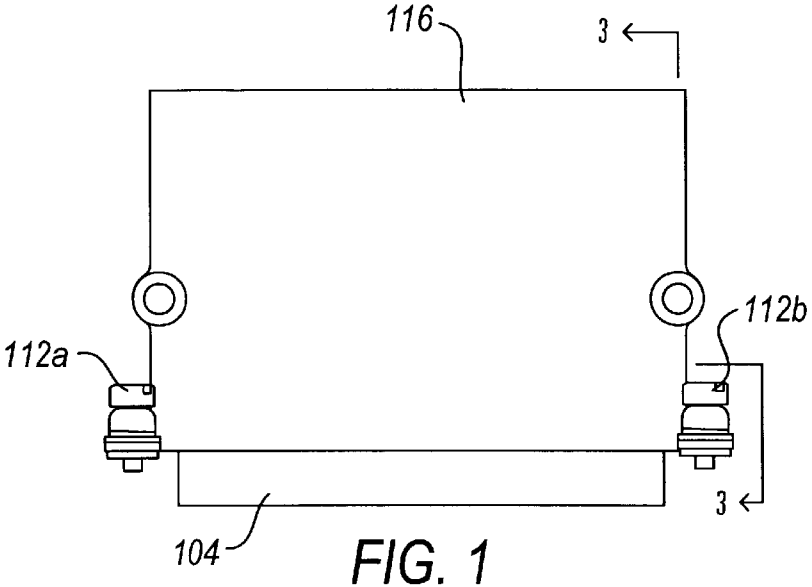
FIG. 1 is a top view of a backshell assembly according to a first embodiment of the present invention.

FIGS. 1–5 depict a first embodiment of a connector assembly according to a first embodiment of the present invention. The connector assembly 100 includes a connecting structure or plug 104 engaged with a backshell assembly 108. The connecting structure 104 and backshell assembly 108 are typically removably connected using one or more suitable connectors such as screws 112*a,b*. The backshell assembly 108 includes upper and lower housing members 116 and 120, a strain relief structure 128 and a ground structure 124. The upper and lower housing members 116 and 120 are typically removably connected using one or more suitable connectors such as screws 310.

Figure 2:
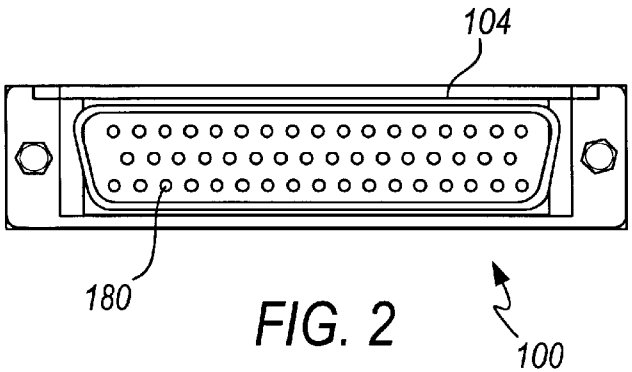
FIG. 2 is a front view of the backshell assembly of FIG. 1.
Figure 4:
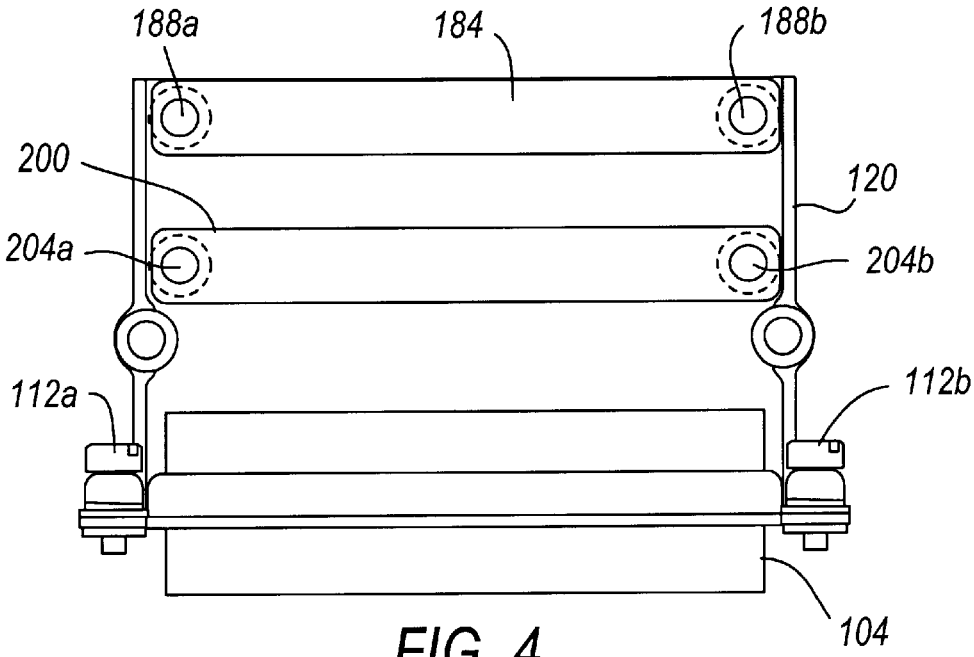
FIG. 4 is cross-sectional view of the lower half of the backshell assembly of FIG. 1 taken along line 4—4 of FIG. 3 with the shields and conductors removed.
Figure 15B:
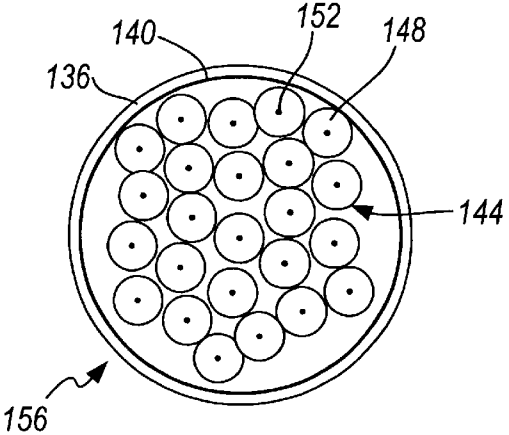
FIGS. 15A and B are respectively an electrical circuit diagram showing the grounding of the shield of one cable configuration and a cross-sectional view of the cable.
Figure 16B:
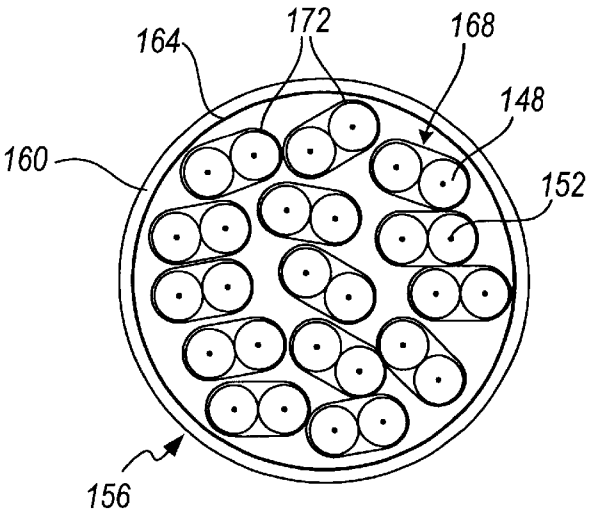
FIGS. 16A and B are respectively an electrical circuit diagram showing the grounding of shield(s) of second and third cable configurations and a cross-sectional view of the cable.

FIGS. 15B and 16B depict possible cable configurations which may be employed with the backshell assembly. Referring to FIG. 15B, the cable 132 in one configuration includes an outer insulative layer 136 and a conductive shield 140 both of which surround a plurality of conductors 144. Each of the plurality of conductors 144 each includes an insulative coating 148 and a conducting element 152. Referring to FIG. 16B, the cable 156 in other configurations includes an outer insulative layer 160 and an outer conductive shield 164 both of which surround a plurality of conductors 168 and a plurality of inner conductive shields 172. As will be appreciated, in some cable designs each inner conductive shield is also covered by an insulative cover or layer. Each inner conductive shield 172 in turn surrounds one or more (but not all) of the conductors 168 contained in the cable 156. A plurality of inner conductive shields 172 is therefore utilized to protect further the conductors 168 in the cable 156. The outer conductive shield 164 is optional in many applications and therefore may be absent from the cable depending on the application. As shown in FIG. 2, connecting elements 180 in the connecting structure 104 connect to each of the conducting elements 152 in either of the cable configurations.

The strain relief structure 128 includes a strain relief bar 184 connected to the lower housing member 120 by means of screws 188*a,b*. As will be appreciated, the strain relief bar 184 is moved downwardly and upwardly by tightening or loosening, respectively, the screws 188*a,b*. The strain relief bar 184 at least substantially inhibits movement of the cable 192 relative to the backshell assembly to prevent the cable 192 from being pulled out of or pushed into the backshell assembly 108 during use. The strain relief bar 184 typically contacts the outer insulative layer 136 and compresses the cable. The outer insulative layer 136 is left in place adjacent to the strain relief bar 184 to protect the various shields and conductors from damage due to direct contact with the bar 184. The strain relief bar 184 can be modified to include serrations or another configuration of uneven surface to enhance the gripping strength of the bar 184. As will be appreciated, any such feature should be relatively shallow in relief to avoid shorting or otherwise damaging a shield or a conductor.

Referring to FIGS. 3–6, the ground structure 124 will be discussed. The ground structure 124 includes a grounding bar 200 connected to the lower housing member 120 by means of screws 204*a,b*. As will be appreciated, the grounding bar 200 is moved in downwardly and upwardly by tightening or loosening, respectively, the screws 204*a,b*. The bar 200 includes a plurality of teeth or serrations 208*a–d* which engage complementary teeth 212*a–c* located on the lower housing member 120. As depicted, the teeth are positioned so as to mesh together; that is, each tooth on the lower housing member is received between adjacent teeth on the bar 200 and vice versa. The enmeshed teeth provide a contact of high electrical integrity and strength with the conductive shields in the cable.

Figure 6:
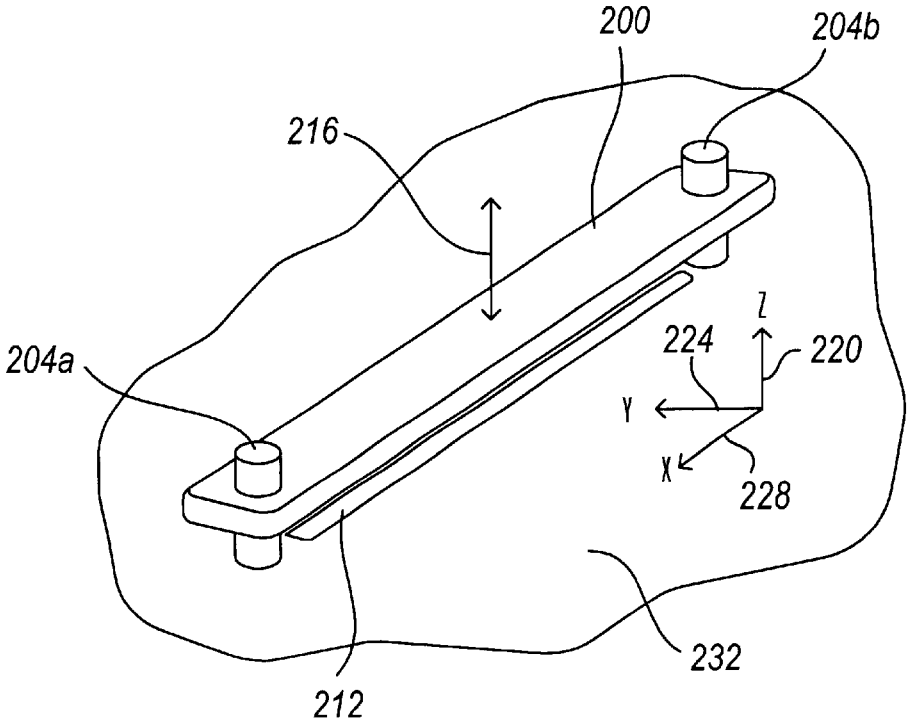
FIG. 6 is a perspective view of the ground structure engaging a portion of the lower backshell housing.
Figure 5A:
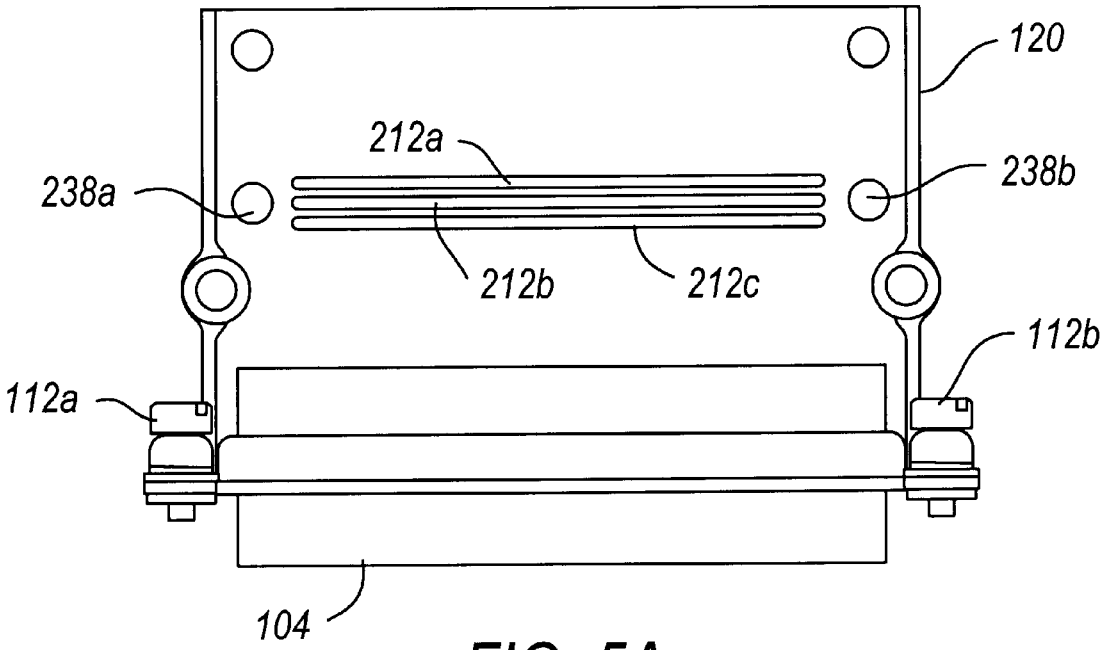
FIG. 5A is a cross-sectional view of the lower half of the backshell assembly of FIG. 1 taken along line 5—5 of FIG. 3 with the shields and conductors removed.
Figure 5B:
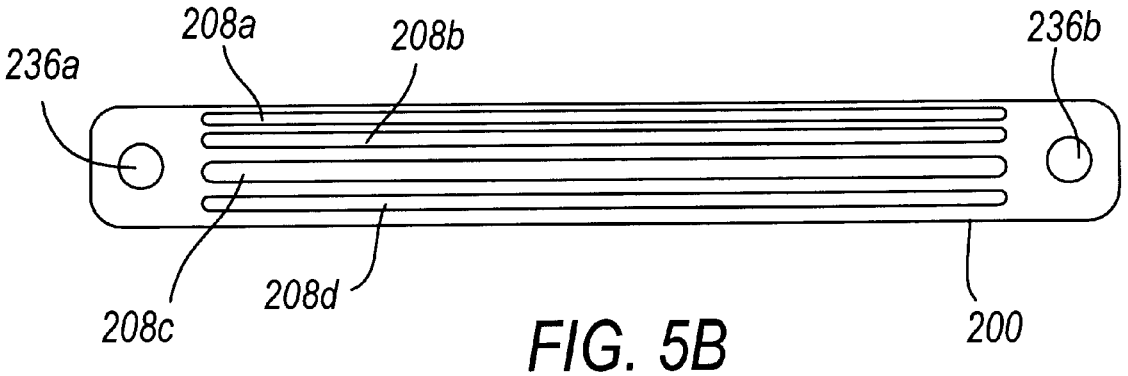
FIG. 5B is a bottom view of the grounding bar.
Figure 7:
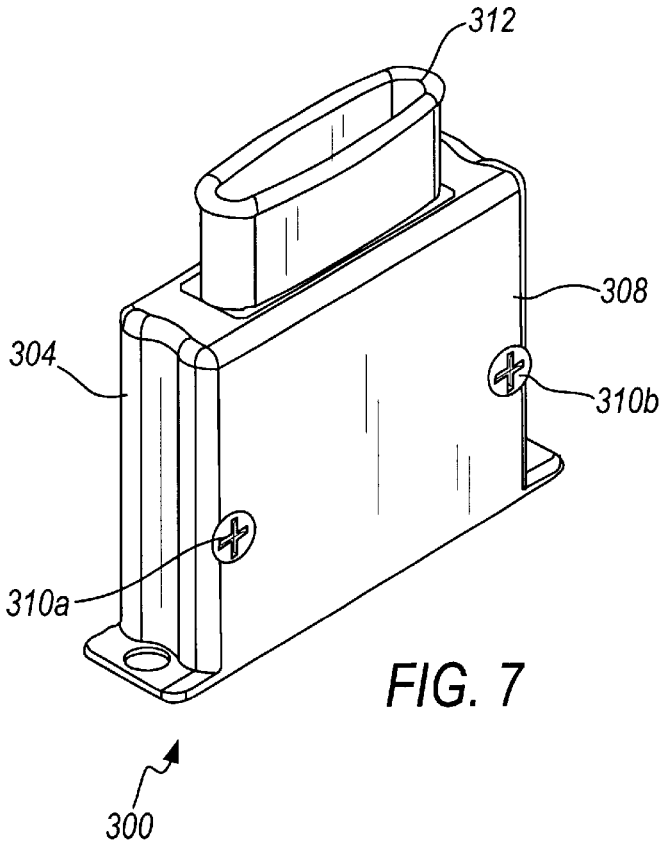
FIG. 7 is a rear perspective view of a backshell assembly according to another embodiment of the present invention.
Figure 9:
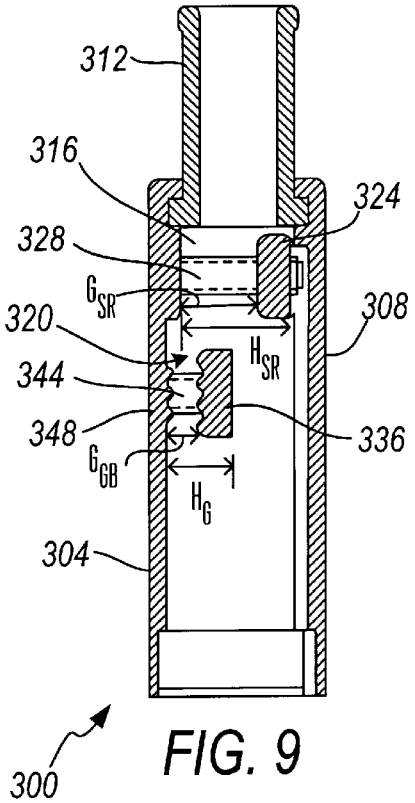
FIG. 9 is a cross-sectional view of the backshell assembly of FIG. 7 taken along line 9—9 of FIG. 8.
Figure 8:
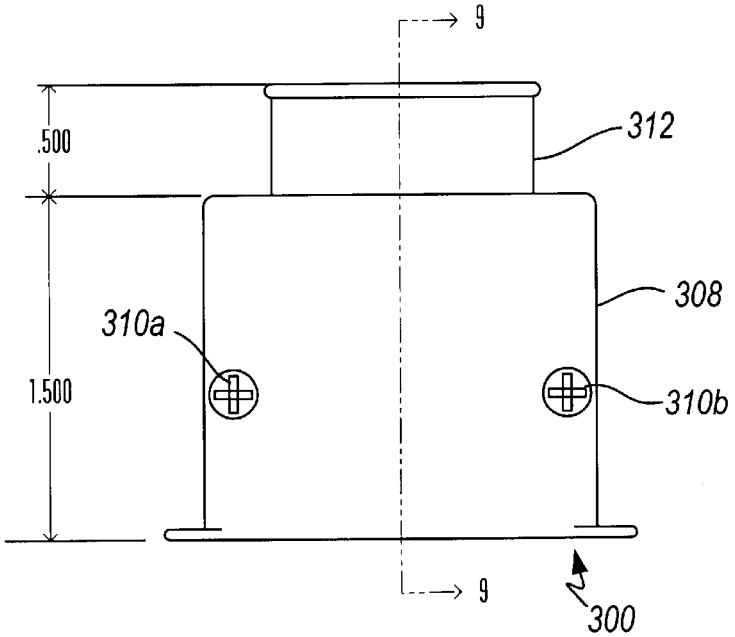
FIG. 8 is a plan view of the backshell assembly of FIG. 7.
Figure 10:
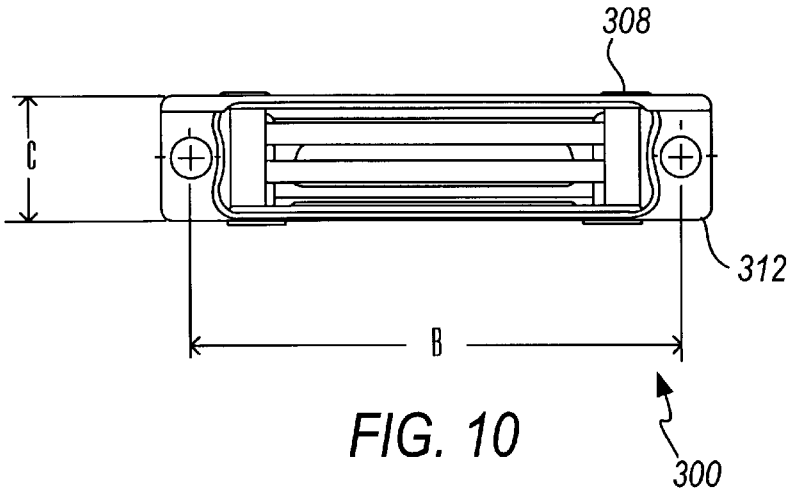
FIG. 10 is a rear view of the backshell assembly of FIG. 7 without the neck insert.
Figure 11:
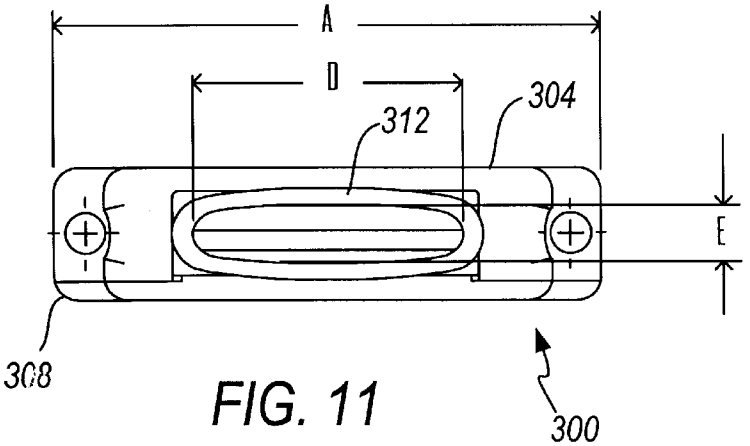
FIG. 11 is a rear view of the backshell assembly of FIG. 7 with the neck insert.
Figure 12:
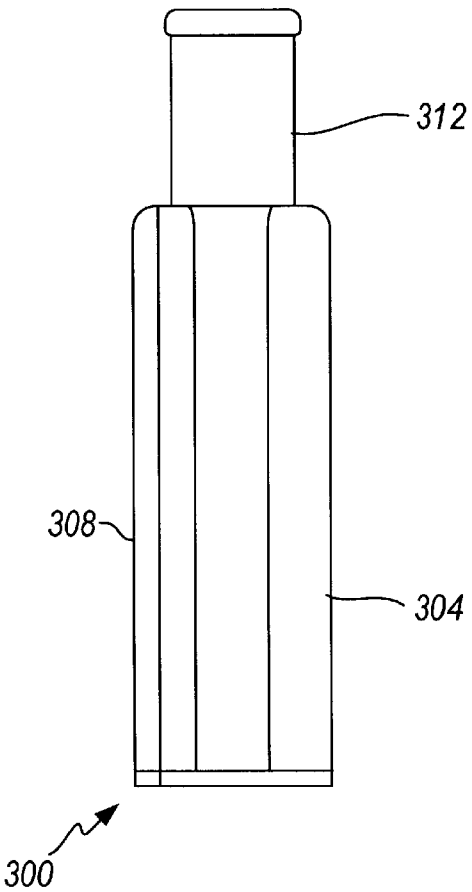
FIG. 12 is a side view of the backshell assembly of FIG. 7.
Figure 13:
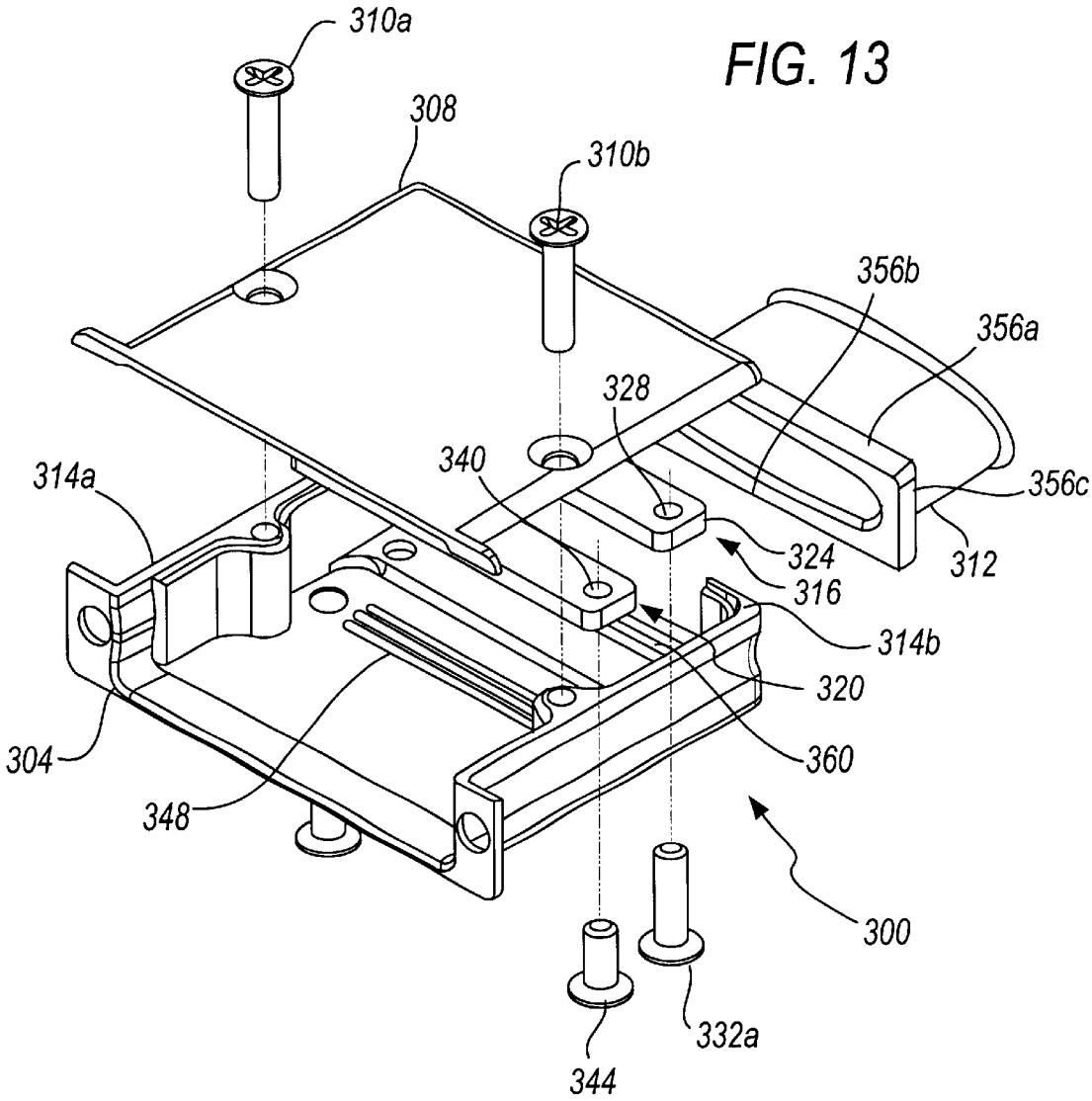
FIG. 13 is an exploded perspective view of the backshell assembly of FIG. 7.

Referring to FIG. 6, the grounding bar 200 is configured so as to reduce (relative to conventional systems) or substantially minimize lateral movement of the shields during tightening of the screws 204*a,b*. The grounding bar 200 moves in a straight-line fashion in direction 216, which is parallel to the Z axis 220. The X and Y axes 224, 228 are in the plane of the interior surface 232 of the lower housing member 120 while the Z axis 220 is substantially normal or orthogonal to the surface 232. The tolerance between the screws 204*a,b* and the corresponding threaded hole 236*a,b* in the bar 200 that receives the screw and the corresponding hole 238*a,b* through the lower housing member 120 that receives the screw are each relatively close to at least substantially inhibit movement of the bar laterally (e.g., in the plane of the surface 232 or in the plane containing the X and Y axes 224, 228). Preferably, the tolerance (or radial distance between the outer screw periphery and adjacent hole wall(s)) is no more than about 0.020 inches and more preferably no more than about 0.010 inches. Preferably, there is at least substantially no movement of the bar 200 (and of each shield after contact with the bar 200) in the plane formed by the X and Y axes.

The assembly of the connector assembly 100 will now be described with reference to FIGS. 1 through 6. The lower housing member 120 is first connected to the connecting structure 104 by tightening screws 112*a,b*. The outer insulative cover 136 or 160 of the cable is then removed to access the various shields and conductors. The braid of each shield 140, 164 and/or 172 is bird caged, and the insulative coating 148 around the free end of each conductive element 152 removed. Preferably, the conductive shields 140, 164, and/or 172 are not cut to avoid generating shards or fragments of the shields which can cause electrical shorts. The cable 132 or 156 is passed through the strain relief structure 128, and the strain relief bar 184 tightened (or lowered) to compress the cable and at least substantially inhibit movement of the cable 132 or 156 relative to the lower housing member 120 in the later steps. The free ends of the various shields 140, 164, and/or 172 are next placed between the upper and lower teeth 208 and 212, and the bar 200 of the ground structure 124 tightened (or lowered) to clamp or compress the shields 140, 164, and/or 172 against the lower housing member 120. The free ends of the conductive elements 152 are then connected typically by soldering or crimping to each of the connecting elements 180 in the connector assembly 104.

Figure 15A:
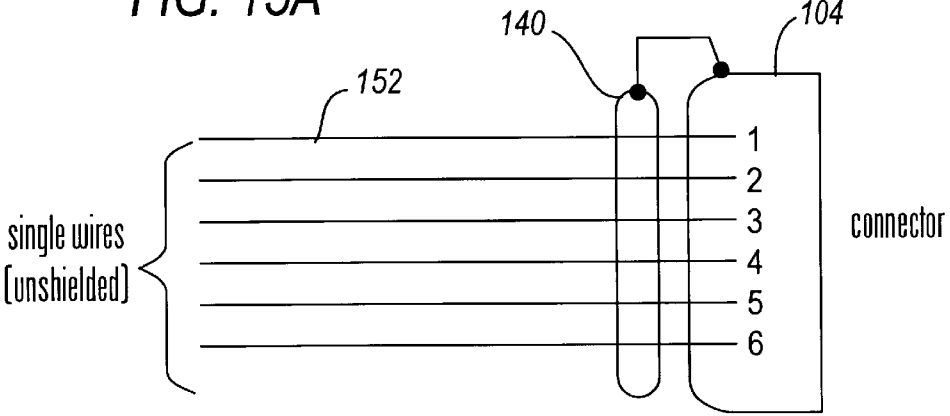
Figure 16A:
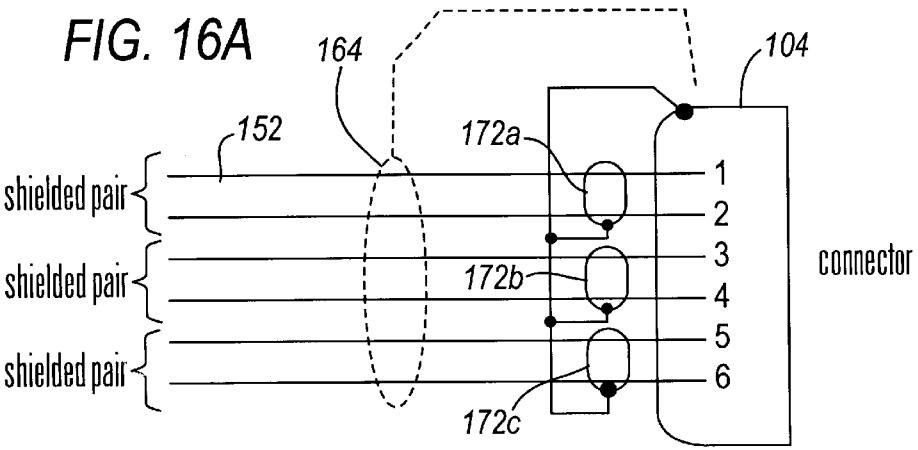

FIGS. 15A and 16A depict the electrical grounding circuit for the differing cable configurations realized through use of the ground structure 124. Referring to FIG. 15A, the single outer conductive shield 140 is grounded to the connector assembly 104, which is further grounded to another connector assembly (not shown) when the two assemblies are plugged together. Referring to FIG. 16A, the individual inner conductive shields 172*a–c*, each of which surrounds a pair of conducting elements 152*a,b*, is grounded to the connector assembly 104. An optional outer conductive shield 164 may also be grounded to the connector assembly 104 by being clamped between the bar 200 and the lower housing member 120 along with the inner conductive shields 172*a–c*.

Another embodiment of a backshell assembly 300 is depicted in FIGS. 7 through 13. The backshell assembly 300 includes a body member 304, a cover 308, a neck insert 312 (which is optional), and strain relief and ground structures 316 and 320. Strain relief structure 316 includes strain relief bar 324 which includes threaded holes 328 which engage screws 332. Ground structure 320 includes grounding bar 336 which includes threaded holes 340 which engage screws 344. Teeth 348 are located in the body member 304 engage the shields as noted above. As can be seen from FIG. 9, the height "$H_G$" is no more than (and is typically less than) the height "$H_{SR}$" to permit the connectors to clear the ground structure 320 and because the gap "$G_{GB}$" between the grounding bar 336 and the body member 304 is not required to be as large as the gap "$G_{SR}$" between the strain relief bar 324 and the body member 304. Neck insert 312 is typically used to provide termination for an outer shield 144, 164 via a conductive band 371. The insert 352 has peripherally disposed lips 356 that are received in slots 360 in the body member 304 and cover 308 (not shown). The slots are, of course, aligned with one another to receive upper and lower lips 356*a,b* therebetween.

Figure 14:
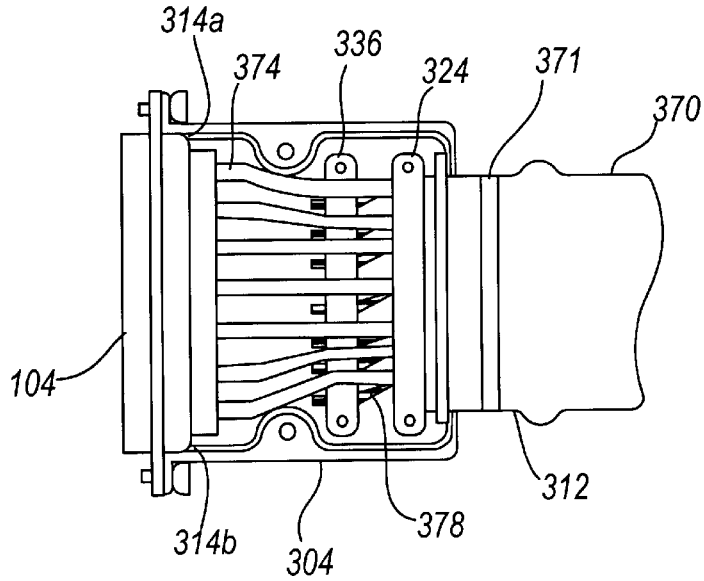
FIG. 14 is a plan view of the various parts of the cable installed in the backshell assembly with the top cover removed.

Referring to FIG. 14, the accessibility of the cable after connection with the backshell assembly is depicted. As can be seen from FIG. 14, the outer shield 144, 164 is passed over the lips 356 of insert 352 and secured to insert 352 with a conductive strap 371. The cable 370 is passed through the neck insert 312 and into the interior of the body member 304. The strain relief bar 324 is tightened to compress the cable and thereby restrain the cable in a fixed position. The conductors 374 are passed over the grounding bar 336 (between the grounding bar and cover) and connected to the connector assembly 104 (such as by soldering). Shields 378 covering one or more conductors 374 are partially stripped from the conductor and clamped between the grounding bar 336 and the teeth 348 in the body member 304. The cover 308 is removably fastened to the body member 304 by means of screws 310*a,b*. A step 314*a,b* in each side of the body member 304 engages a similarly shaped step in the cover to provide lateral (side-to-side) rigidity.

The foregoing description of the present invention has been presented for purposes of illustration and description. Furthermore, the description is not intended to limit the invention to the form disclosed herein. Consequently, variations and modifications commensurate with the above teachings, in the skill or knowledge of the relevant art, are within the scope of the present invention. The embodiments described here and above are further intended to explain best modes for practicing the invention and to enable others skilled in the art to utilizing the invention in such, or other, embodiments and with various modifications required by the particular applications or uses of the present invention. It is intended that the appended claims be construed to include alternative embodiments to the extent permitted by the prior art.

What is claimed is:

1. A connector for terminating a plurality of shielded conductors, comprising:

a conductive backshell housing including a passage for receiving a plurality of conductors, the passage being disposed at a distal end of the conductive backshell housing;

a connecting structure including a plurality of connecting elements for connecting to the corresponding plurality of conductors wherein each of a plurality of conductive shields surrounds one or more of the plurality of conductors, the plurality of connecting elements being disposed at a proximal end of the conductive backshell housing;

one or more ground structures for grounding each of the plurality of conductive shields, each of the one or more ground structures being located inside the conductive backshell housing between the plurality of connecting elements and the passage and clamping each of the plurality of conductive shields; and a strain relief structure for restraining movement of the plurality of shielded conductors relative to the backshell housing.

2. The connector of claim 1, wherein the strain relief structure contacts an insulative cover enclosing the conductive shields and the plurality of shielded conductors.

3. The connector of claim 1, wherein the strain relief structure comprises a stationary bar and a moveable bar, clamps the plurality of shielded conductors between the stationary bar and the moveable bar and is located inside the backshell housing and near an opening of the passage.

4. The connector of claim 1, wherein the strain relief structure is located between the ground structure and the distal end of the backshell housing.

5. The connector of claim 1, wherein the ground structure comprises a stationary bar and a surface of the conductive backshell housing and clamps the conductive shield between the stationary bar and the surface of the conductive backshell housing.

6. The connector of claim 5, wherein the moveable bar includes a conductive material.

7. The connector of claim 1, wherein the one or more ground structures each include a clamping bar, at least one end of which is secured to the conductive backshell housing, for electrically connecting at least a portion of the plurality of conductive shields with the conductive backshell housing.

8. The connector of claim 7, wherein the clamping bar is connected to the conductive backshell housing such that the bar moves in a direction that is at least substantially normal to at least a portion of a grounding surface of the backshell housing to engage the plurality of shields but is at least substantially free of movement in a direction parallel to the grounding surface.

9. A connector for terminating a plurality of shielded conductors, comprising:

a conductive backshell housing including a passage for receiving a plurality of conductors, the passage being disposed at a distal end of the conductive backshell housing;

a connecting structure including a plurality of connecting elements for connecting to the corresponding plurality of conductors wherein each of a plurality of conductive shields surround one or more of the plurality of conductors, the plurality of connecting elements being disposed at a proximal end of the conductive backshell housing;

a strain relief structure for restraining movement of the plurality of shielded conductors relative to the backshell housing; and shield grounding means for clamping each of the plurality of conductive shields to a grounding surface of the conductive backshell housing, the shield grounding means being configured to maintain alignment with the grounding surface during engagement of the shield grounding means with the plurality of conductive shields.

10. The connector of claim 9, wherein a grounding bar of the shield grounding means has freedom of movement in a direction at least substantially normal to the grounding surface of the backshell housing to engage the plurality of conductive shields and is at least substantially free of movement in a direction at least substantially parallel to the grounding surface.

11. A method for securing a plurality of shielded conductors to a connecting assembly, comprising:

(a) removing a portion of an insulating cover enclosing the plurality of conductors to provide access to a plurality of conductive shields enclosing the plurality of conductors;

(b) placing the plurality of conductively shielded conductors enclosed by the insulating cover into a strain relief structure in the connecting assembly;

(c) compressing the plurality of conductors in the strain relief structure to restrain movement of the plurality of conductors relative to a conductive backshell housing in the connecting assembly;

(d) clamping the accessible portions of the plurality of conductive shields with a ground structure in the connecting assembly, wherein at least a portion of the ground structure that contacts the plurality of conductive shields is at least substantially free of rotation in the clamping step (d); and (e) connecting the plurality of shielded conductors to a plurality of connecting elements in the connecting assembly.

12. The method of claim 11, wherein the clamping and compressing steps occur at different times.

13. The method of claim 11, wherein an unremoved portion of the insulating cover contacts the strain relief structure.

14. A method for grounding a plurality of shielded conductors, comprising:

(a) providing a plurality of conductive shields surrounding a plurality of conductors;

(b) passing the plurality of conductively shielded conductors through a passage in a backshell housing of a connecting assembly;

(c) engaging the plurality of conductively shielded conductors with a strain relief structure in the connecting assembly;

(d) clamping the accessible portions of the plurality of conductive shields with a ground structure in the connecting assembly, wherein at least a portion of the ground structure that contacts the plurality of conductive shields is at least substantially free of rotation in the clamping step (d); and (e) connecting the plurality of shielded conductors to a plurality of connecting elements in the connecting assembly.

15. The method of claim 14, wherein the engaging step (c) includes the step of compressing the plurality of conductors in the strain relief structure to restrain movement of the plurality of conductors relative to a conductive backshell housing in the connecting assembly.

16. The method of claim 14, wherein the clamping step (d) occurs interiorly of the passage.

17. The method of claim 14, wherein the ground structure includes a movable bar that moves in straight line motion relative to a ground surface of the backshell housing.

18. The method of claim 14, wherein the ground structure includes a moveable bar that moves downwardly and upwardly relative to a ground surface of the backshell housing.

19. The method of claim 14, wherein the grounded conductive shields are externally accessible via a removable plate after the clamping step (d).

20. The method of claim 14, wherein the ground structure includes one or more serrations for clamping the grounded conductive shields.

21. A method for grounding a plurality of shielded conductors, comprising:

(a) providing a plurality of conductive shields enclosing a plurality of conductors;

(b) passing the plurality of conductively shielded conductors through a passage in a backshell housing of a connecting assembly;

(c) engaging the plurality of conductively shielded conductors with a strain relief structure in the connecting assembly;

(d) after the passing step, engaging portions of the plurality of conductive shields with a ground structure in the connecting assembly; and (e) connecting the plurality of shielded conductors to a plurality of connecting elements in the connecting assembly, wherein the ground structure includes a movable bar that moves in straight line motion relative to a ground surface of the backshell housing.

22. A method for grounding a plurality of shielded conductors, comprising:

(a) providing a plurality of conductive shields enclosing a plurality of conductors;

(b) passing the plurality of conductively shielded conductors through a passage in a backshell housing of a connecting assembly;

(c) engaging the plurality of conductively shielded conductors with a strain relief structure in the connecting assembly;

(d) after the passing step, engaging portions of the plurality of conductive shields with a ground structure in the connecting assembly; and (e) connecting the plurality of shielded conductors to a plurality of connecting elements in the connecting assembly, wherein the ground structure includes a moveable bar that moves downwardly and upwardly relative to a ground surface of the backshell housing.

23. A method for grounding a plurality of shielded conductors, comprising:

(a) providing a plurality of conductive shields enclosing a plurality of conductors;

(b) passing the plurality of conductively shielded conductors through a passage in a backshell housing of a connecting assembly;

(c) engaging the plurality of conductively shielded conductors with a strain relief structure in the connecting assembly;

(d) after the passing step, engaging portions of the plurality of conductive shields with a ground structure in the connecting assembly; and (e) connecting the plurality of shielded conductors to a plurality of connecting elements in the connecting assembly, wherein the grounded conductive shields are externally accessible via a removable plate after engaging step (d).

* * * * *